US005617972A

United States Patent [19]

Morano et al.

[11] Patent Number: 5,617,972

[45] Date of Patent: Apr. 8, 1997

[54] NURSER LINER

[75] Inventors: Emanuel P. Morano, Totowa, N.J.; Anthony E. Flecknoe-Brown, Richmond, Australia

[73] Assignees: Playtex Products Inc., Westport, Conn.; Tetra Laval Holdings & Finance S.A., Pully, Switzerland

[21] Appl. No.: 409,872

[22] Filed: Mar. 24, 1995

Related U.S. Application Data

[63] Continuation-in-part of Ser. No. 218,314, Mar. 25, 1994, Pat. No. 5,501,365.

[51] Int. Cl.[6] ..... B65H 1/00

[52] U.S. Cl. ..... 221/33; 206/519

[58] Field of Search ..... 221/33, 63, 68; 206/515, 519; 215/10, 11.1

[56] References Cited

U.S. PATENT DOCUMENTS

| | | | |
|---|---|---|---|
| D. 202,507 | 10/1965 | Shelby | D44/9 |
| 985,328 | 2/1911 | Decker | 215/11 |
| 2,110,928 | 3/1938 | De Buys | 215/11 |
| 2,338,397 | 1/1944 | Beasley | 229/4.5 |
| 2,508,481 | 5/1950 | Allen | 215/11 |
| 2,530,124 | 11/1950 | Kieckhefer | 206/65 |
| 3,292,811 | 12/1966 | Lynch | 220/4 |
| 3,358,879 | 12/1967 | Mueller | 206/519 |
| 3,396,868 | 8/1968 | Fitzgerald | 206/519 |
| 3,406,853 | 10/1968 | McLeod | 215/11 |
| 3,471,075 | 10/1969 | Wolf | 229/1.5 |
| 3,485,412 | 12/1969 | Hawley | 220/97 |
| 3,609,263 | 9/1971 | Clementi | 220/60 R |
| 3,623,634 | 11/1971 | Norgard | 220/97 R |
| 3,642,165 | 2/1972 | von der Osten | 220/23.83 |
| 3,762,625 | 10/1973 | Mojonnier | 229/17 G |
| 3,776,408 | 12/1973 | Wald | 215/11 E |
| 3,777,925 | 12/1973 | Eckholm | 215/11 E |
| 3,784,039 | 1/1974 | Marco | 215/11 E |
| 3,800,843 | 4/1974 | Edwards | 150/0.5 |
| 3,851,781 | 12/1974 | Marco | 215/10 |
| 3,970,206 | 7/1976 | Morash | 215/11 R |

*Primary Examiner*—Kenneth Noland

*Attorney, Agent, or Firm*—Ohlandt, Greeley Ruggiero & Perle

[57] ABSTRACT

There is provided a nurser liner that facilitates stacking and nesting of the liner while maximizing liner capacity. In particular, it permits a plurality of the liners to be contained within a container having limited internal space while allowing the liners to de-nest properly and individually from the container. The nurser liner includes a rim that is located at one end of the liner and a step that is located a predetermined distance from the rim. In addition, the outer walls of the liner are slightly tapered inward from the rim. The step and the tapered outer walls insure uniform spacings between nested liners for easy dispensing, optimal spacing between liners and maximum liner capacity.

46 Claims, 8 Drawing Sheets

NURSER LINER

RELATED APPLICATION

This application is a continuation-in-part of U.S. patent application Ser. No. 8/218,314, filed on Mar. 25, 1994 now U.S. Pat. No. 5,501,365 titled A PACKAGE AND SYSTEM FOR DISPENSING PREFORMED NURSER SACS.

BACKGROUND OF THE INVENTION

I. Field of the Invention

This invention relates to disposable liners or sacs for use in a nurser bottle. More particularly, the invention relates to preformed, pre-sterilized and disposable liners that can be stacked and nested within a packaging container.

With the expanded use of disposable liners, a need has developed for a liner constructed so that a plurality of liners can be conveniently stored in a minimum amount of space, while maximizing thus also the size or capacity of each individual liner. A common problem is the size of the container and the shelf space that can be allocated to hold a sufficient number of liners. To minimize the amount of space, the liners need to be in a nesting arrangement, e.g., one upon another, within a container. However, this nesting arrangement must not diminish the total capacity of each liner to a level that is substantially below the capacity of existing liners. For example, since a vast majority of liners are of a capacity to hold eight ounces of fluid, it is desirable to design a liner that meets this industry requirement.

With such a nesting arrangement, there is an additional need for each liner to readily disengage from the remainder of the stack during dispensing. Thus, there has been, heretofore, a need for an inexpensive, disposable liner in which a large number of liners can be stacked in a defined area and, yet, each liner can be readily separated from the remainder of the stack while meeting industry capacity requirements.

II. Description of the Prior Art

Nurser liners that have an upper, firm flange or rim to facilitate the positioning and assembly of the liner on a holder are shown in U.S. Pat. No. 958,328 to Decker, which issued on Feb. 28, 1911; U.S. Pat. No. 2,110,928 to De Buys, which issued on Mar. 15, 1938; U.S. Pat. No. 2,508,481 to Allen, which issued on May 23, 1950; and U.S. Pat. No. 3,776,408 to Wald, which issued on Dec. 4, 1973.

Also, nurser liners that permit an individual liner to separate freely from the remaining liners are known. For example, U.S. Pat. No. 3,851,781 to L. S. Marco, which issued on Dec. 3, 1974, provides a disposable plastic container having an upper wall portions or step and a lower wall portion or step that are configured to permit stacking of the containers in package form. For stacking two containers, the lower wall portion of one container rests on top of the upper wall portion of the other container. Thus, individual containers can be readily removed from the nested stack as long as each container has two wall portions or steps. Also, U.S. Pat. No. 3,970,206 to P. G. Morash, which issued on Jul. 20, 1976, provides a similar construction of stackable feeding assemblies.

However, the above patents do not provide a nurser liner having a unique structural design for nesting and for stacking a plurality of such liners within a limited amount of space while maximizing each liner's capacity. Furthermore, these liners also do not minimize the material costs and the amount of space needed in a container.

SUMMARY OF THE INVENTION

It is an object of the present invention to provide a nurser liner having a new and improved structure for nesting and de-nesting a plurality of such liners within a limited space, such as a dispensing container.

It is another object of the present invention to provide such a nurser liner for nesting and de-nesting that meets industry capacity requirements for nurser liners, namely a volume capacity of eight ounces but in a container having a height no greater than eight and one quarter inches.

It is still another object of the present invention to provide such a nurser liner that readily permits the liners to separate or de-nest from the stack.

It is yet another object of the present invention to provide such a nurser liner having a step structure for maintaining a separation between adjacent liners in a nested stack. In a preferred embodiment, the step maintains the same predetermined separation between adjacent liners.

It is a further object of the present invention to provide such a nurser liner having a wall surface that is slightly tapered to allow proper nesting and de-nesting while meeting industry volume capacity and height requirements.

It is a still further object of the present invention to provide such a nurser liner having a rim that is flexible enough to dispense from a rigid container while being rigid enough to be supported within a nurser liner holder.

It is a yet further object of the present invention to provide such a nurser liner having a rim with a rib, to reduce leakage of liquids or other consumables contained within the liner.

These and other objects of the present invention are provided by a nurser liner that comprises a liner body having an open end and an offset portion such that the offset portion is located a predetermined distance from the open end. The liner also comprises a rim located at the open end of the liner body which rim has an inner rim circumference, and a step located at the offset portion of the liner body which step has an outer step circumference. The outer step circumference is greater than the inner rim circumference.

The above, and other objects, features and advantages of the present invention will become apparent from the following description read in conjunction with the accompanying drawings, in which like reference numerals designate the same elements.

BRIEF DESCRIPTION OF THE DRAWINGS

The foregoing and still other objects and advantages of the present invention will be more apparent from the following detailed explanation of the preferred embodiments of the present invention in connection with the accompanying drawings wherein.

DETAILED DESCRIPTION OF THE PREFERRED EMBODIMENT

Figure 1:
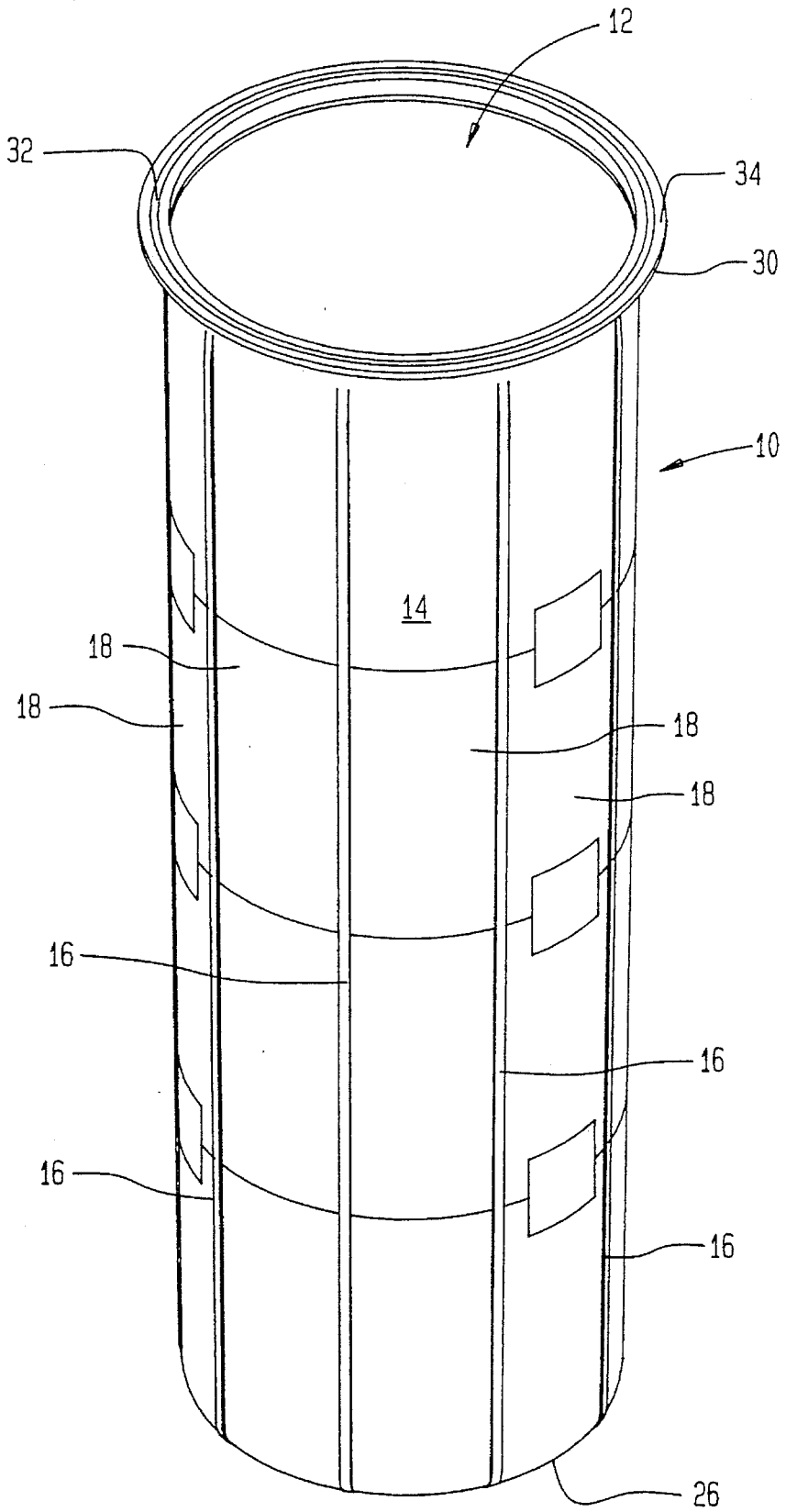
FIG. 1 is a perspective view of the nurser liner of the present invention.

Referring to the figures and, in particular, FIG. 1, there is shown a preferred embodiment of the present invention having a nurser liner generally represented by reference numeral 10. The nurser liner 10 comprises a generally cylindrical, tapered sack having an open end 12 and a liner body 14.

The outer surface of the liner body 14 may be smooth and uniform, or may include variations for improved aesthetic quality and/or physical properties. For the preferred embodiment, the liner body 14 includes vertical indentations or ridges 16 formed preferably longitudinally along its outer surface, as shown in FIG. 1. It has been found that situating a plurality of ridges, preferably a minimum of 4 ridges, uniformly along the outer surface of the liner body 14 improves the tensile strength of the liner 10. The maximum number of ridges that may be situated on the liner body 14 is limited only by the surface area available for such ridges. However, it is more preferred to situate from 4 to 24 ridges on the liner body 14 and, most preferably, nine uniformly spaced ridges.

The ridges 16 of the preferred embodiment are not only decorative in nature but, as stated above, also provide structural support and reinforcement for the liner body 14 for improved durability. It is preferred that the ridges 16 are evenly separated apart to provide uniform load distribution and permit the liner to uniformly collapse inward. Therefore, due to the structure and position of the ridges 16, the liner body 14 initially collapses laterally inward and then longitudinally upward or downward.

The open end 12 of the nurser liner 10 has a resilient flange or rim 30, preferably along its entire circumference. For the preferred liner 10, the rim 30 is made of the same flexible material as the liner body 14. However, the rim 30 of the preferred liner 10 is thicker, and thus harder and more resilient, than the liner body 14.

Figure 2:
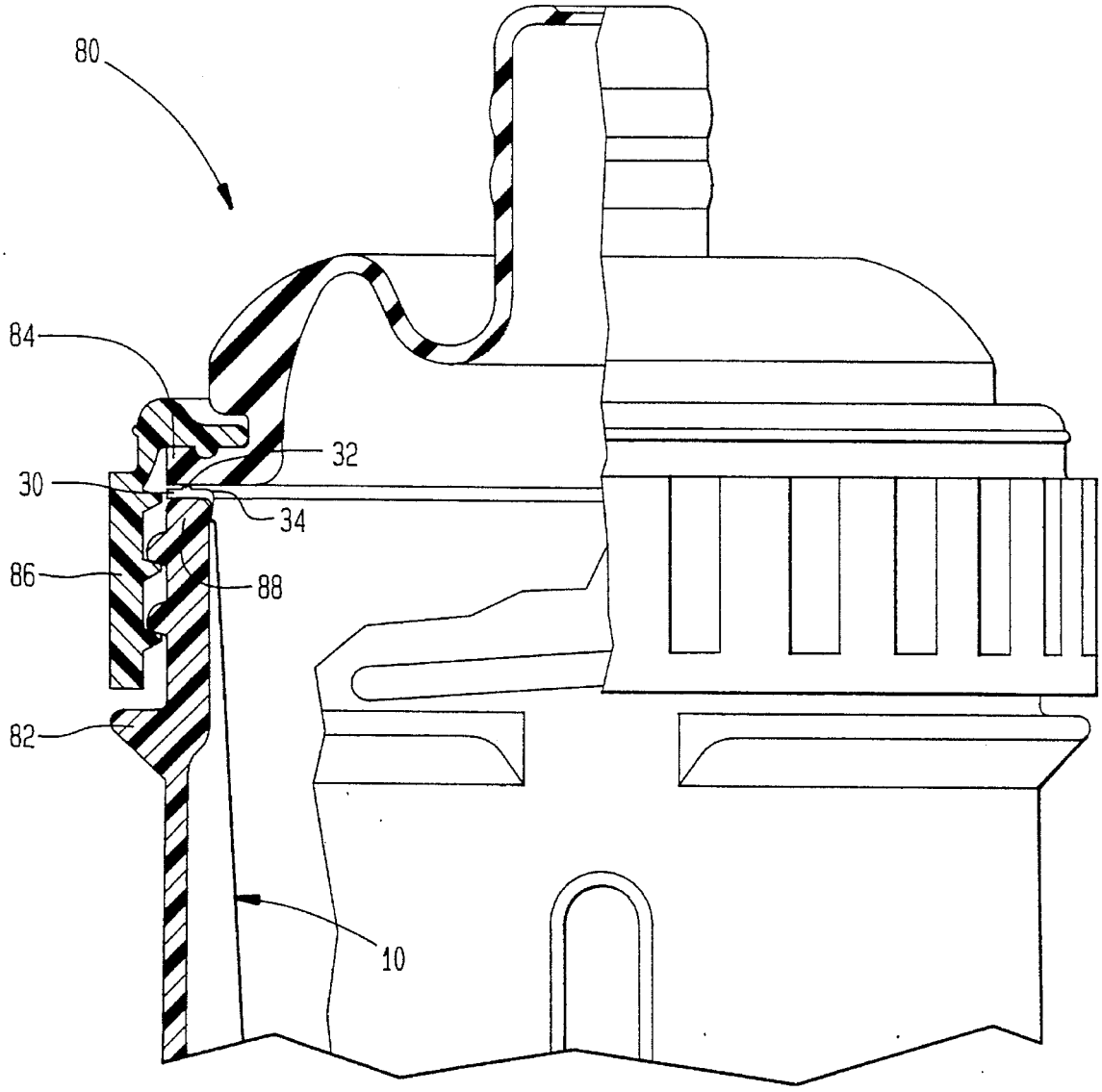
FIG. 2 is a sectional view of a portion of the nurser liner of FIG. 1 that shows the position of the liner within a typical nurser bottle.
Figure 3:
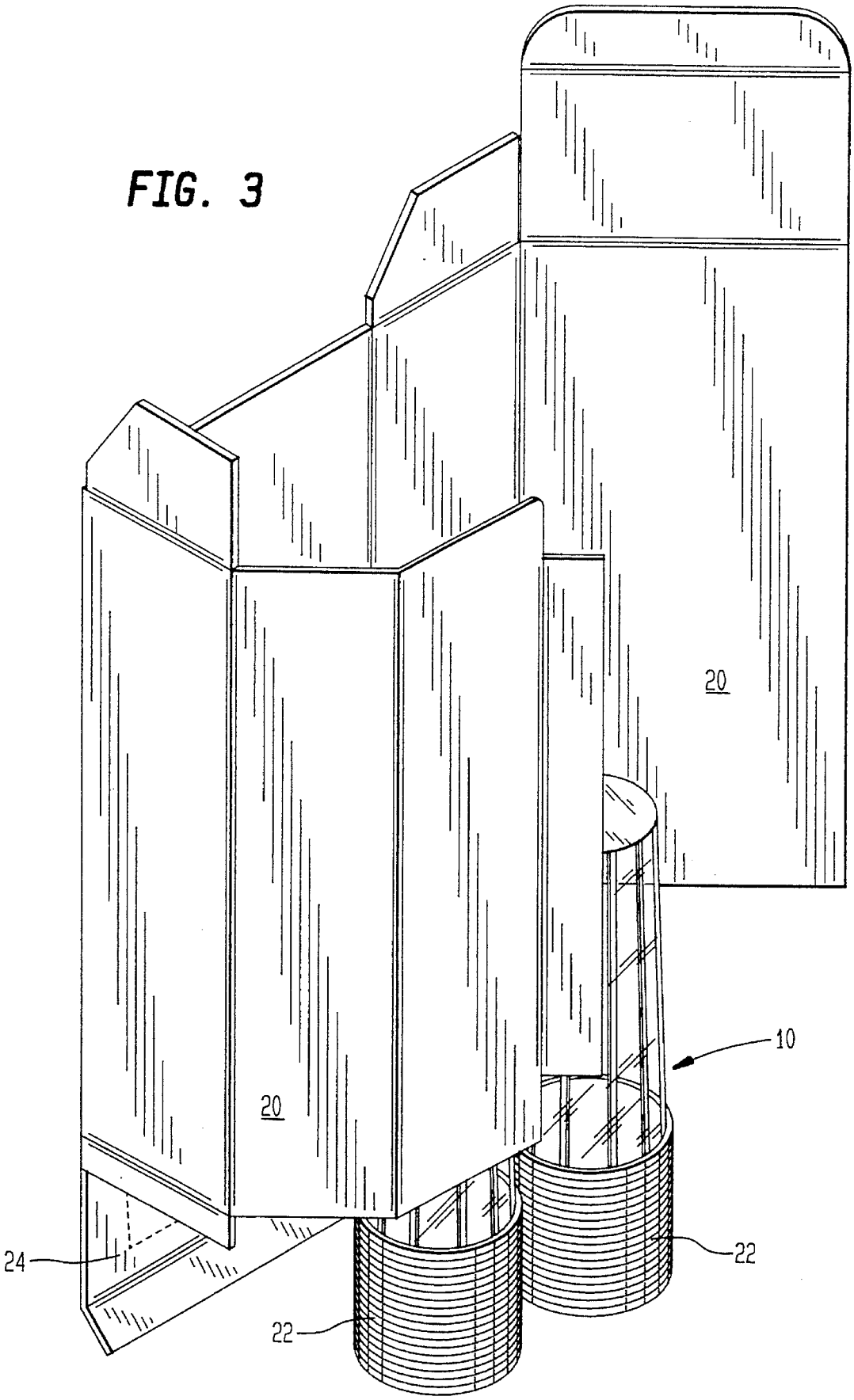
FIG. 3 is a perspective view of two stacks of nested nurser liners that are partially removed from an open box container.

The rim 30 needs to be flexible enough to dispense from a dispensing package, such as the container 20 shown in FIG. 3. At the same time, the rim 30 must be rigid enough to support the weight of fluid contained therein when mounted in a liner holder 82, as shown in FIG. 2, so as not to fall through the upper rim of the holder. This has been achieved by a combination of proper rim thickness and material selection as set forth in this application.

Any type of flexible material, or combination of materials, may be used to construct the nurser liner 10 of the present invention. These materials include, but are not restricted to, low density polyethylene (LDPE), linear low density polyethylene (LLDPE), medium density polyethylene (MDPE), high density polyethylene (HDPE), polypropylene (PP) and ethylene vinyl acetate (EVA). Any of the above materials may be 100% virgin or incorporate regrind of the same material of up to 70%. In addition, the nurser liner 10 of the present invention may comprise a co-extrusion of film or sheet that combines two or more layers of various resins to form one composite material, such as a material having a layer of LDPE and a layer of HDPE.

A preferred liner 10 is made of polyethylene resin. A more preferred material is a low density polyethylene (LDPE) resin, and a most preferred material is a linear low density polyethylene resin. Such preferred resins include the DOWLEX Linear Low Density Polyethylene Resin by Dow Plastics; PE 5754 High Clarity, High Impact Film Resin by Chevron Chemical; and, Escorene Low Density Polyethylene LD-103 Industrial Film Resin by Exxon Chemicals. These resins have a specific gravity between about 0.917 and about 0.940 grams per milliliter.

Referring to FIG. 2, a bead 32 is formed on a top surface 34 of the rim 30. In the preferred embodiment shown, the bead 32 is formed about the circumferential center of the top surface 34. For a typical nurser assembly 80, the rim 30 of the liner 10 is held between a liner holder 82 and a nipple flange 84. A screw-type retainer ring 86 clamps the nipple flange 84 to an upper rim 88 of the liner holder 82. For the preferred embodiment, as the retainer ring 86 is tightened, the bead 32 of the liner 10 is slightly compressed between the liner holder 82 and the nipple flange 84 to create a seal that prevent liquids from passing out of the nurser assembly 80. In addition, after securing the liner 10 between the liner holder 82 and the nipple flange 84, the bead 32 prevents the liner from rotating within the nurser assembly 80 until the retainer ring 86 is released.

Referring to FIG. 3, the nurser liners are held within a dispenser or container 20 and stacked in a nested arrangement, that is one on top of another, to minimize space. In addition, as each nurser liner 10 is stacked one on another, the stacking creates random convoluted surfaces. This convolute action decreases the amount of surface area contact between the liners 10 and, thus, the surface friction. Therefore, this stacking design facilitates separation of the individual nurser liners when dispensed from the container 20.

In a preferred embodiment, the plurality of nurser liners 10 are in two stacks 22 positioned in the container 20 with each stack in a nesting arrangement. In a preferred container, each stack 22 is in a generally vertical orientation with the open ends 12 of the liners 10 directed downward within the container 20. In this orientation, the lowermost liner 10 of each stack 22 is adjacent to the bottom flap 24 of the container 20.

Figure 4:
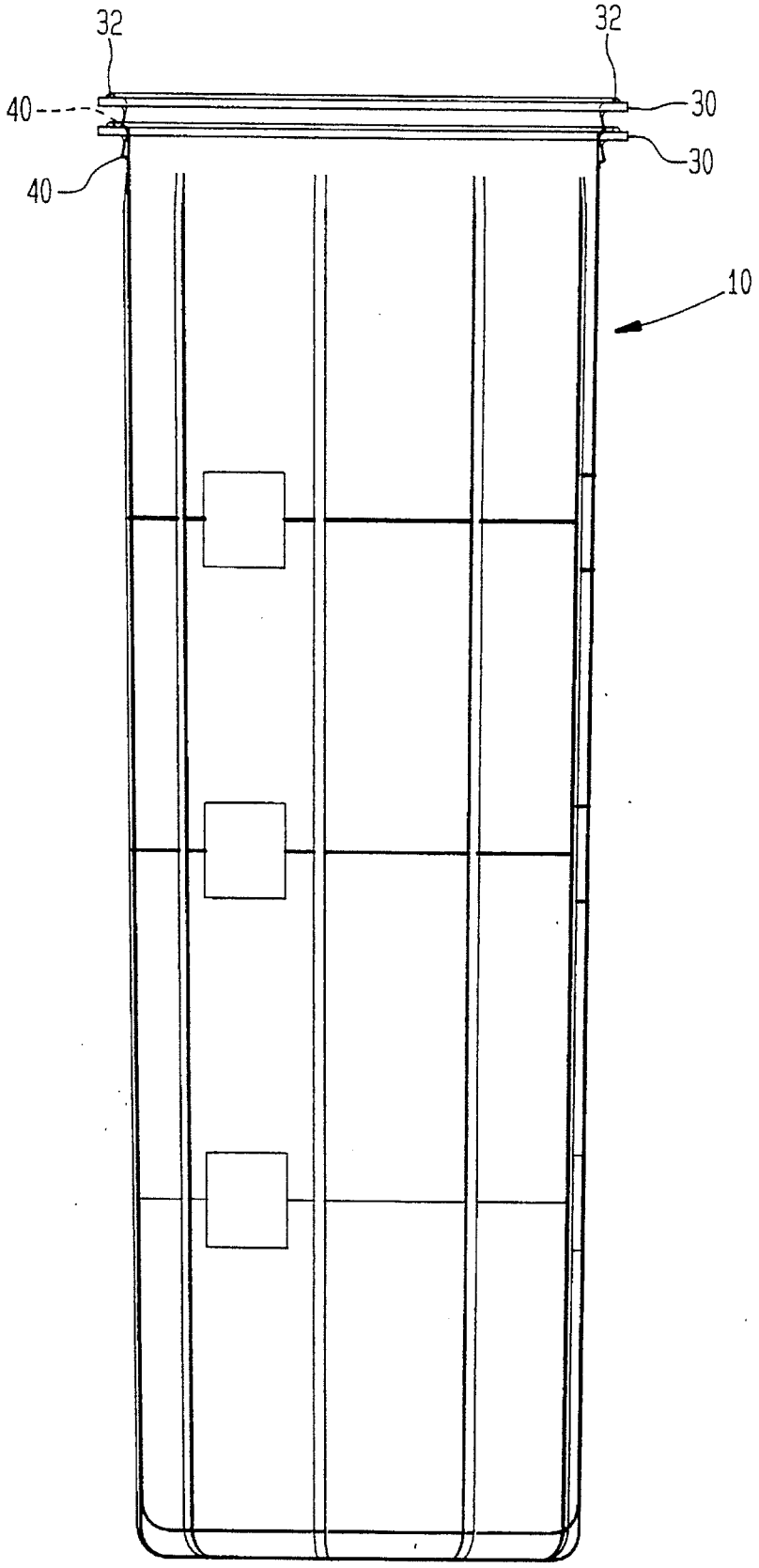
FIG. 4 is a side view of two nurser liners with one liner nested within the other.

As shown in FIG. 4, when stacking or nesting the nurser liners 10, each rim 30 is spaced slightly from the next adjacent rim to minimize the surface friction between adjacent liner walls and, thus, facilitate separation. Each pair of adjacent rims 30 should have an allowable space, formed via a step 40, to facilitate separation, yet be sufficiently close to minimize the total amount of space needed in the container 20 (shown in FIG. 3). Preferably, each step 40 provides enough separation to permit a person's fingers to touch a rim during the separation process. It has been found that each step 40 creates excellent spacing for separation of the liners 10, as described below.

Figure 5:
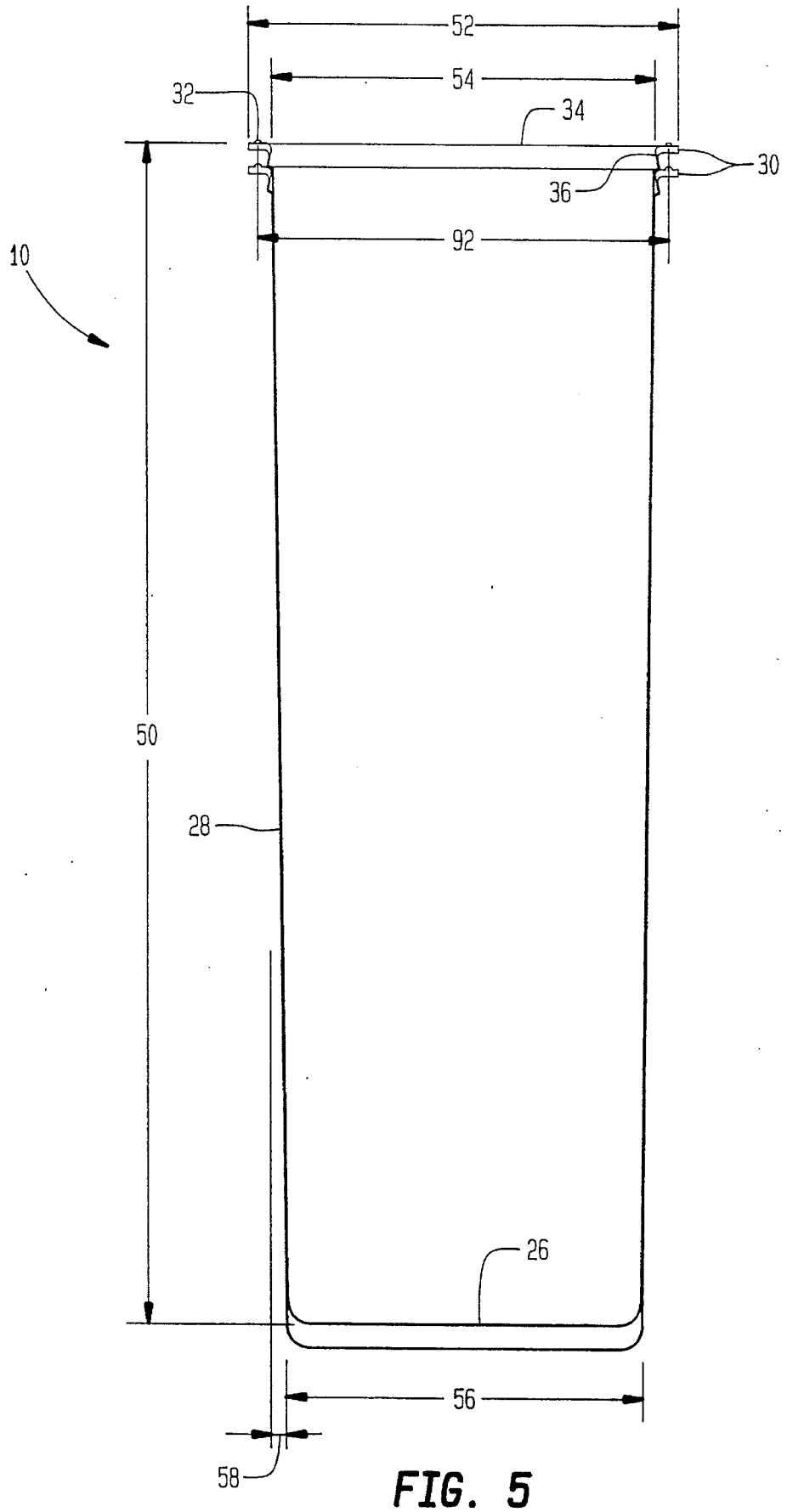
FIG. 5 is a sectional view of the two nurser liners of FIG. 4.

Referring to FIG. 5, each liner 10 of the preferred embodiment has an overall height 50, minus the bead 32, from about 5.25 inches to about 6.500 inches. The outer rim circumference 52 of each liner 10 when measured from the top surface 34 of the rim 30 is from about 5.966 inches to about 7.065 inches. The inner rim circumference 54 of each liner 10 when measured from the inside surface 36 at the rim is from about 5.574 inches to about 6.594 inches, and an outer bottom circumference 56 at the terminus of the bottom or closed end 26 of each liner 10 is from about 4.710 inches to about 5.966 inches. For the most preferred embodiment, the overall height 50 is about 5.709 inches, the outer rim circumference 52 is about 6.563 inches, the inner rim circumference 54 is about 5.947 inches and the outer bottom circumference 56 at closed end 26 is about 5.379 inches.

As described above for FIG. 1, a plurality of ridges 16 are evenly distributed on the liner body 14 to permit the liner to uniformly collapse inward during use as a vacuum is formed when feeding. This collapsing feature (not shown) of the present invention may also facilitate permit one liner to nest within another liner during the initial stacking process. Therefore, to place the liners 10 in the nesting arrangement of the present invention, it is only required that the outer bottom circumference 56 of the liner be no greater than the inner rim circumference 54.

However, it has been determined that tapering the outer wall surface 28 of the liner 10 affects the nesting and de-nesting properties, as well as the volume and packaging requirements, of the liner 10. Thus, for the preferred embodiment, each liner 10 has a continuous wall surface 28 that tapers, as indicated by reference numeral 58, from the rim 30 to the closed end 26 of the liner. It is preferred that the degree of taper 58 of the wall surface 28 can be zero and up to about two (2.0) degrees. A taper of greater than two degrees causes each liner 10 to take-up an insufficient amount of volume for standard package requirements and to fail to maximize total volume capacity desired by the industry. Accordingly, it is more preferred that the degree of taper 58 of the wall surface 28 be about seven tenths (0.7) of a degree.

Figure 6:
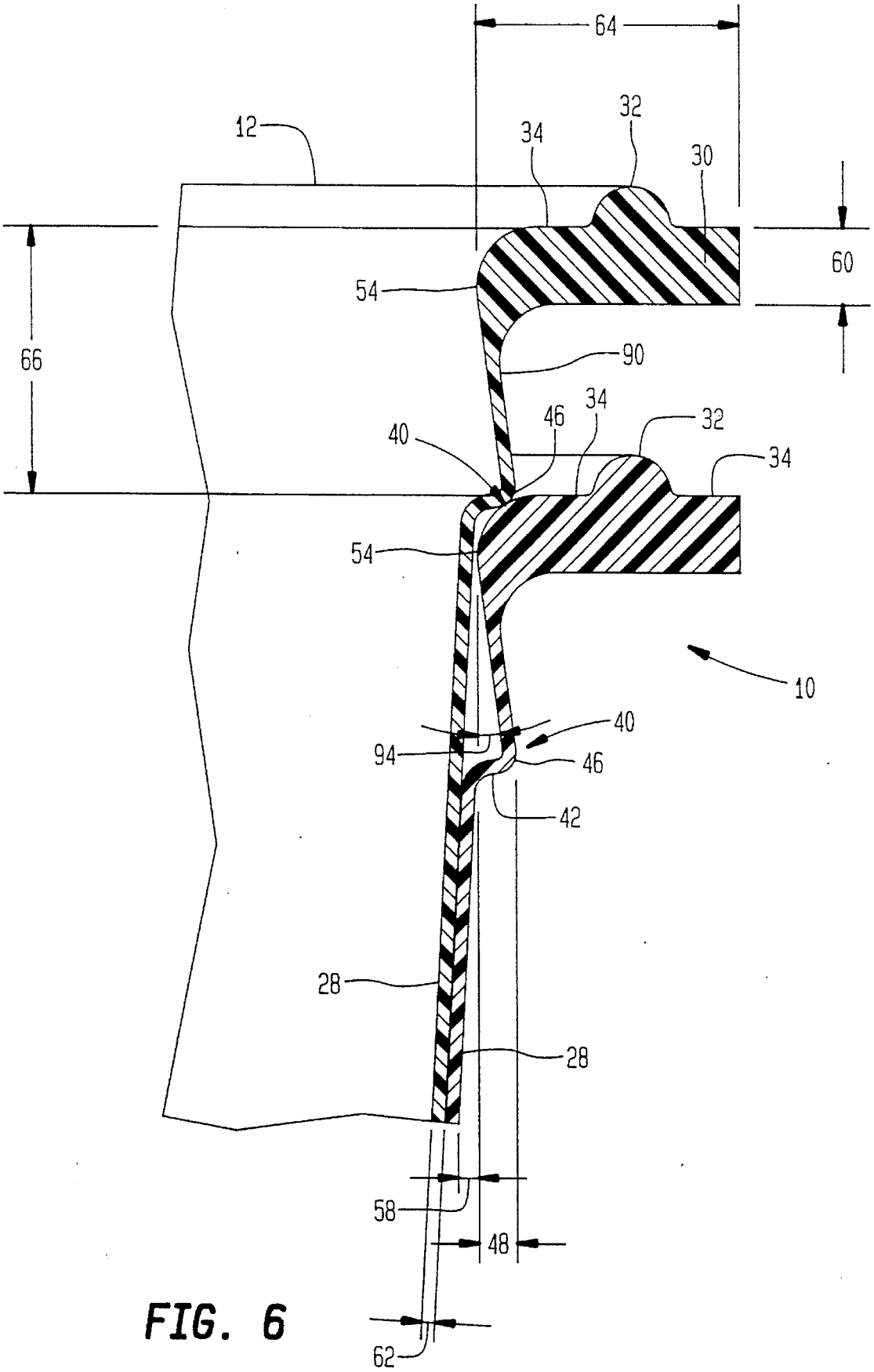
FIG. 6 is an enlarged view of the upper rim portions of the two nurser liners of FIG. 5.

Referring to FIG. 6, the rim 30 is located at the open end 12 of the liner 10 whereas the step 40 is located at a distal offset position away from the open end. The step 40 has a lower surface 42 that abuts the top surface 34 of an adjacent liner 10. The distance between the top surface 34 of the rim 30 and lower surface 42 of a step 40 of any given liner 10 determines, and is proportionally equal to, the separation distance or length 66 between adjacent liners. It has been found that the separation distance 66 between adjacent liners 10 is from about 0.030 inches to about 0.500 inches, and preferably about 0.100 inches. This separation distance 66 permits one to readily grasp the rim 30 of the liner 10 that is to be dispensed, yet provides only the smallest amount of separation necessary for grasping.

An outer step circumference 46 of the step 40 must be greater than the inner rim circumference 54 of the rim 30 so that the step of one liner 10 may rest on the top surface 34 of another liner. For the preferred embodiment, this is accomplished by tapering the step 40, as extended from the rim 30 to the lower surface 42, away from the liner body 14 at a predetermined angle 94. It is preferred that the predetermined angle 94 of the step's taper is about 0 degrees to about 30 degrees, and more preferably about 8.5 degrees. The outer step circumference 46, which forms the step 40, is preferably about 5.966 inches. In addition, the continuous wall surface 28 must taper 58 from the rim 30 to the closed end 26 of the liner 10 so that the liners will have sufficient room to stack upon each other.

The step 40, located below the rim 30, provides a positive stop to insure a uniform spacing between nested liners 10. The uniform spacing affects the stack height of the liners 10 in the dispenser or container, such as container 20 shown in FIG. 2.

The width or radial extant 48 of the step 40 is from about 0.010 inches to about 0.100 inches, and preferably about 0.020 inches, as shown in FIG. 6.

During manufacturing of the preferred embodiment, it has been discovered that a small aberration (not shown) may develop on an intermediate portion 90 of the outer wall of the nurser liner between the rim 30 and the step 40 upon formation of the step. Although this aberration is noticeable upon close inspection of the intermediate portion 90, the aberration does not affect the performance characteristics of the present invention.

As shown in FIG. 6, the rim 30 has a thickness 60 that is greater than the thickness 62 of the liner body 14. Also, the width 64 of the rim 30 is such that the rim extends substantially beyond the outer surface of the liner body 14. Preferably, the thickness of the rim 30 ranges from about 0.010 inches to about 0.100 inches. The rim 30 has a preferred thickness of about 0.028 inches, and a preferred width of about 0.10 inches when using linear low density polyethylene resin. These values may, however, vary in order to change the flexibility of the flange or when other materials are used.

The outer circumference of the rim 30 and the height of the liner 10 are dependent on the type and dimensions of the liner holder 82 (shown in FIG. 2) used to support the liner. As stated before, typically, the overall height of each liner 10 is from about 5.25 inches to about 6.500 inches and the outer circumference of the rim 30 is from about 5.966 inches to about 7.065 inches. Most preferably, the overall height is about 5.709 inches and the outer circumference is about 6.563 inches.

Figure 7:
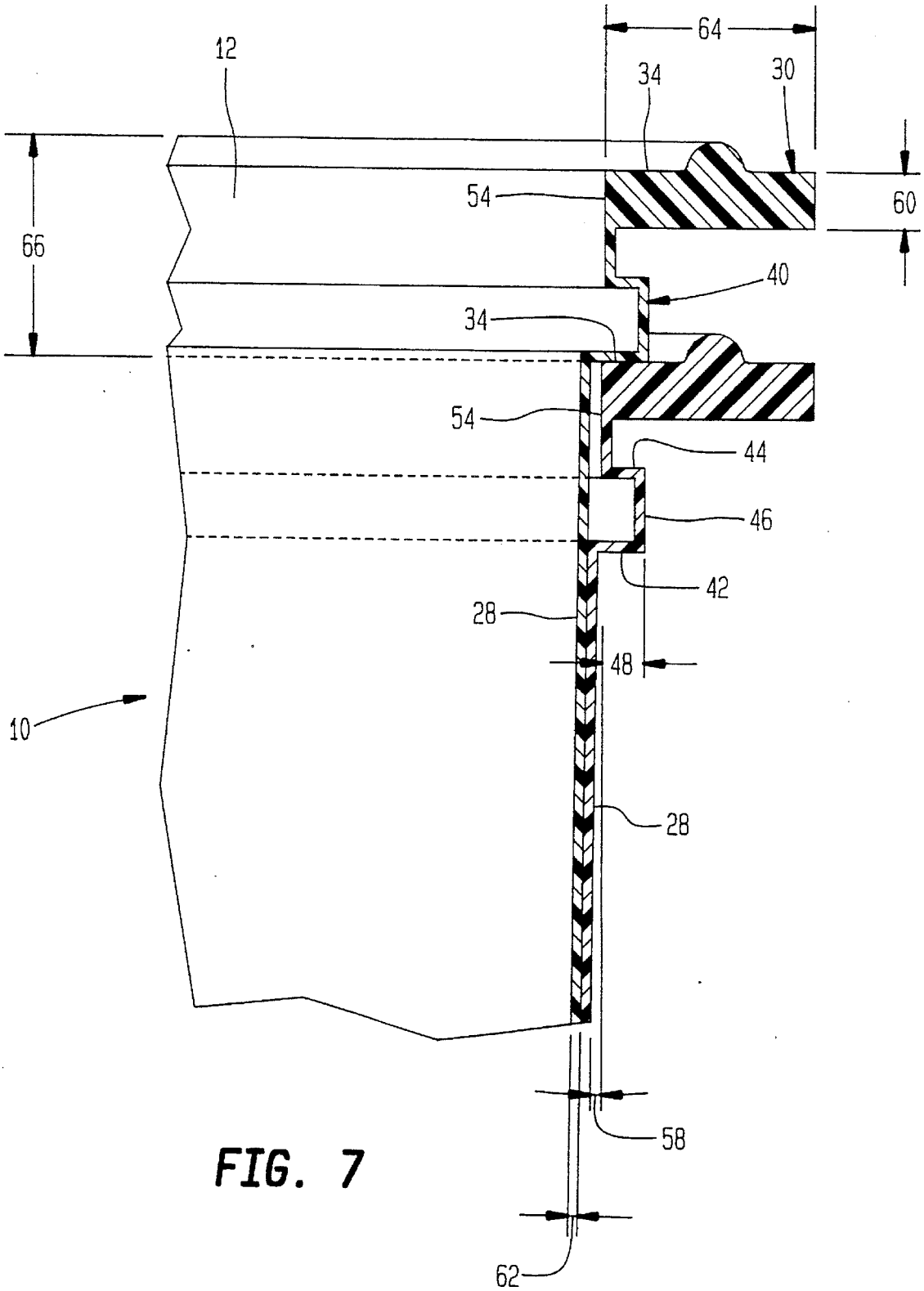
FIG. 7 is a sectional view of an alternative rim of the nurser liners of the present invention.

An alternative embodiment of the nurser liner 10 is shown in FIG. 7. This alternative liner 10 has edges that are more angular and distinct than the liner of the preferred embodiment. Also, the step 40 of the liner 10 has an upper surface 44 as well as a lower surface 42. Although permissible, the upper surface 44 is not necessary for the stacking and nesting function of the liners 10 of the present invention.

Figure 8A:
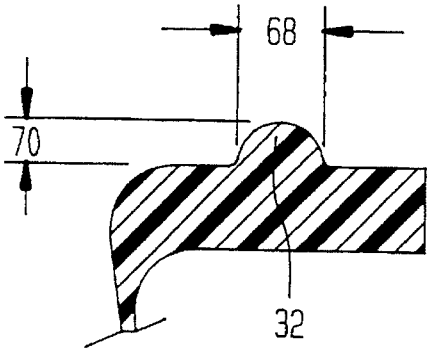
FIG. 8A is partial view of one of the upper rim portions of FIG. 6.
Figure 8B:
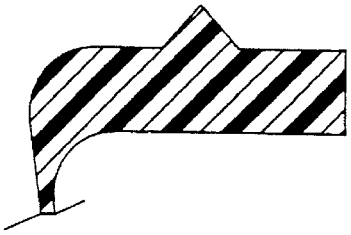
FIG. 8B through 8E are alternative views of the upper rim portion of FIG. 8A.
Figure 8C:
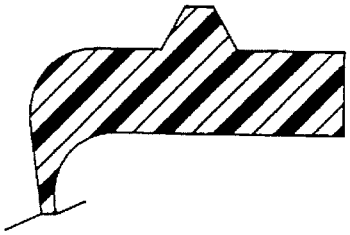
Figure 8D:
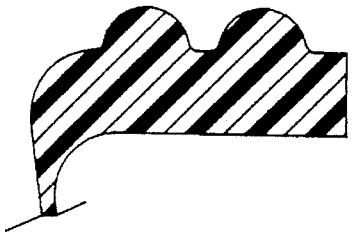
Figure 8E:
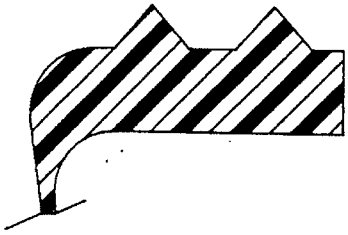

Referring to FIGS. 8A through 8C, the bead 32 of the rim 30 may have a variety of shapes and configurations. The preferred form of the bead 32 is an arcuate shape, more preferably a semi-circular mound or half-moon shape, on the top surface 34 as shown in FIG. 8A. For the preferred arcuate shape, the width 68 of the bead 32 is about 0.030 inches and the height 70 of the bead is about 0.016 inches. The circumference 92 of the entire bead ring, as shown in FIG. 5, is about 6.255 inches. Other alternative shapes, such as a triangular and trapezoidal mound, are shown in FIGS. 8B and 8C. Further, a plurality of beads may be formed at the top surface 34, as shown by FIGS. 8D and 8E.

The present invention having been thus described with particular reference to the preferred forms thereof, it will be obvious that various changes and modifications may be made therein without departing from the spirit and scope of the present invention as defined in the appended claims.

Wherefore, we claim:

1. A nurser liner for containment within a predetermined volume of space, said nurser liner comprising:

an elongated liner body having an open end;

a rim being located at said open end, said rim having a radial portion and an axial portion, said axial portion having an inner circumference; and a single step being located adjacent said rim, said step having a first surface virtually perpendicular to said radial portion of said rim, and having a second surface basically parallel to said radial portion of said rim but located a predetermined distance from said rim, said second surface having an outer circumference, wherein said outer circumference of said second surface of said step is greater than said inner circumference of said rim, and wherein said step precludes a second nurser liner which has been stacked therein from contacting said rim thereby facilitating removal of the second nurser liner from said liner body.

2. The nurser liner of claim 1, wherein said predetermined distance is the same as an extent of said first surface.

3. The nurser liner of claim 1, wherein said first surface, as extended from said rim to said second surface, angles away from said liner body.

4. The nurser liner of claim 3, wherein said angle of said first surface is about 0 degrees to about 30 degrees.

5. The nurser liner of claim 1, wherein said step includes a third surface and a fourth surface.

6. The nurser liner of claim 5, wherein said third surface is substantially parallel to said first surface and said fourth surface is substantially parallel to said second surface.

7. The nurser liner of claim 1, wherein said second surface of said step has an inner step circumference.

8. The nurser liner of claim 7, wherein said liner body includes a closed end located opposite said open end of said liner body with said closed end having an outer periphery, wherein said inner step circumference of said step is greater than a circumference of said outer periphery of said closed end.

9. The nurser liner of claim 7, wherein the distance from said outer circumference of said second surface to said inner step circumference of said second surface is from about 0.010 inches to about 0.100 inches.

10. The nurser liner of claim 9, wherein a distance from said outer circumference of said second surface to said inner step circumference of said second surface is about 0.020 inches.

11. The nurser liner of claim 1, wherein said liner body comprises a closed end located opposite said open end, wherein said liner body tapers circumferentially inward from said rim to said closed end.

12. The nurser liner of claim 11, wherein said liner body tapers from said rim to said closed end by an angle no greater than about 2.0 degrees.

13. The nurser liner of claim 12, wherein said liner body tapers from said rim to said closed end by an angle of about 0.7 degrees.

14. The nurser liner of claim 1, wherein said inner circumference of said rim is about 5.574 inches to about 6.594 inches.

15. The nurser liner of claim 14, wherein said inner circumference of said rim is about 5.947 inches.

16. The nurser liner of claim 1, further comprising a bead extending upward from a portion of said rim.

17. The nurser liner of claim 16, wherein said bead has an arcuate shape.

18. The nurser liner of claim 16, wherein said bead has a triangular shape.

19. The nurser liner of claim 16, wherein said bead has a polygonal shape.

20. The nurser liner of claim 1, further comprising a plurality of beads extending upward from a portion of said rim.

21. The nurser liner of claim 1, wherein said rim comprises at least one material selected from the group consisting of: low density polyethylene, linear low density polyethylene, medium density polyethylene, high density polyethylene, polypropylene and ethylene vinyl acetate.

22. A stack of nurser liners for containment within a predetermined volume, said stack comprising:

a plurality of nurser liners, each liner having an elongated liner body with a central axis, each liner body having an open end and a closed end, wherein each liner body forms a taper from said open end to said closed end by an angle up to about 2.0 degrees;

a first liner of said plurality of nurser liners having a flexible rim located at said open end, said rim having a radial portion and an axial portion, said rim having a bead positioned on a top surface of said rim; and means, positioned adjacent and below said rim, for spacing said first liner from an adjacent, second liner of said plurality of nurser liners;

said second liner having a rim located at said open end;

wherein when said first liner is positioned in said second liner, said means prevents said rim of said first liner from contacting said rim of said second liner to facilitate denesting of said first liner from said second liner.

23. The stack of nurser liners of claim 22, wherein said spacing means comprises a single step, said step having a first surface that is located virtually parallel to the central axis of said liner body and a second surface that is located virtually radial to said liner body but located a predetermined distance from said open end, wherein said second surface of said step of said second liner abuts said radial portion of said rim of said first liner so that said first liner is separated from said second liner by a predetermined separation length.

24. The stack of nurser liners of claim 23, wherein said predetermined distance is the same as an extent of said first surface.

25. The stack of nurser liners of claim 23, wherein said first surface of said step of said second liner, as extended from said open end to said second surface, angles away from said liner body.

26. The stack of nurser liners of claim 25, wherein said angle of said first surface is about 0 degrees to about 30 degrees.

27. The stack of nurser liners of claim 23, wherein said first surface and said second surface meet at an arcuate edge.

28. The stack of nurser liners of claim 23, said step of said second liner includes a third surface and a fourth surface.

29. The stack of nurser liners of claim 28, wherein said third surface is substantially parallel to said first surface and said fourth surface is substantially parallel to said second surface.

30. A stack of nurser liners for containment within a predetermined volume, said stack comprising:

a plurality of nurser liners, each liner having an elongated liner body with a central axis and an open end;

a first liner of said plurality of nurser liners having a flexible rim located at said open end, said rim having a radial portion and an axial portion, said rim having a bead positioned on a top surface of said rim; and means, positioned adjacent and below said rim, for spacing said first liner from an adjacent, second liner of said plurality of nurser liners;

wherein when said first liner is positioned in said second liner, said spacing means prevents said rim of said first liner from contacting said rim of said second liner, and wherein said first liner is separated from said second liner by a predetermined separation length, wherein said predetermined separation length is about 0.030 inches to about 0.500 inches.

31. The stack of nurser liners of claim 30, wherein said predetermined separation length is about 0.100 inches.

32. A nurser liner for containment of a liquid therein and adapted to be secured in a nurser holder having a nipple removably secured thereto, said nurser liner comprising:

an elongated liner body having an open end and a closed end located opposite said open end;

a flexible rim located at said open end, wherein said liner body tapers inward from said open end to said closed end by an angle up to about 2.0 degrees;

a bead extending upward from a top portion of said rim to prevent the liquid from leaking from between said nurser liner and the nipple when said nurser liner is secured in the nurser holder and to prevent rotation of said nurser liner; and means, positioned adjacent and below said rim, for spacing said rim from a rim of an adjacent second nurser liner that has said nurser liner positioned therein.

33. The nurser liner of claim 32, wherein said bead has an arcuate shape.

34. The nurser liner of claim 32, wherein said bead is formed approximately at a center of said top portion of said rim.

35. The nurser liner of claim 32, wherein said rim is more resilient than said liner body.

36. The nurser liner of claim 32, wherein said rim comprises at least one material selected from the group consisting of low density polyethylene, linear low density polyethylene, medium density polyethylene, high density polyethylene, polypropylene, ethylene vinyl acetate and combinations thereof.

37. The nurser liner of claim 32, wherein said rim has a thickness from about 0.010 inches to about 0.100 inches.

38. The nurser liner of claim 32, wherein said rim has a width from about 0.010 inches to about 0.100 inches.

39. The nurser liner of claim 32, wherein said liner body has a height from about 5.25 inches to about 6.50 inches.

40. The nurser liner of claim 32, wherein said rim has an inner circumference from about 5.574 inches to about 6.594 inches.

41. The nurser liner of claim 32, wherein said rim has an outer circumference from about 5.966 inches to about 7.065 inches.

42. A nurser liner for containment of a liquid therein and adapted to be secured in a nurser holder having a nipple removably secured thereto, said nurser liner comprising:

an elongated liner body having an open end and a closed end located opposite said open end, said liner body having a height from about 5.25 inches to about 6.50 inches;

a rim, located at said open end, being more resilient than said liner body, said rim having a radial portion and an axial portion, wherein said liner body tapers inward from said open end to said closed end by an angle up to about 2.0 degrees;

a bead extending upward from a top portion of said rim to prevent the liquid from leaking from between said nurser liner and the nipple when said nurser liner is secured in the nurser holder and to prevent rotation of said nurser liner; and means, positioned adjacent and below said rim, for spacing said rim from a rim of an adjacent second nurser liner that has said nurser liner positioned therein, wherein said spacing means precludes the rim of said second nurser liner from contacting said rim of said nurser liner thereby facilitating denesting of said nurser liner from the second nurser liner.

43. The nurser liner of claim 42, wherein said spacing means creates a separation that is about 0.030 inches to about 0.500 inches.

44. The nurser liner of claim 42, wherein said bead is formed at a center of said top portion of said rim.

45. The nurser liner of claim 42, wherein said bead has an arcuate shape.

46. The nurser liner of claim 42, wherein said bead has an arcuate shape, and is formed at a center of said top portion of said rim.

* * * * *